United States Patent [19]

Ohashi et al.

[11] Patent Number: 5,071,494

[45] Date of Patent: Dec. 10, 1991

[54] AGED COPPER ALLOY WITH IRON AND PHOSPHOROUS

[75] Inventors: Yasusuke Ohashi; Toshihiro Fujino; Yasuhito Taki; Tamotsu Nishijima, all of Shizuoka, Japan

[73] Assignee: Yazaki Corporation, Tokyo, Japan

[21] Appl. No.: 643,306

[22] Filed: Jan. 22, 1991

Related U.S. Application Data

[63] Continuation of Ser. No. 356,097, May 24, 1989.

[51] Int. Cl.[5] ..... C22C 9/00; C22C 9/08

[52] U.S. Cl. ..... 148/411; 148/432; 420/491

[58] Field of Search ..... 148/411, 432; 420/491

[56] References Cited

U.S. PATENT DOCUMENTS 4,605,532 8/1986 Knorr et al. ..... 148/432

FOREIGN PATENT DOCUMENTS 58-161743 9/1983 Japan ..... 420/491

61-266540 11/1986 Japan .

*Primary Examiner*—H. Dean

*Assistant Examiner*—Margery S. Phipp

*Attorney, Agent, or Firm*—Sughrue, Mion, Zinn Macpeak & Seas

[57] ABSTRACT

An aged copper alloy comprising:

0.15–1.0 wt % Fe, 0.05–0.3 wt % P, and 0.05–0.3 wt % Mg and 0.05–0.3 wt % Pb with the balance being essentially composed of Cu.

1 Claim, 1 Drawing Sheet

AGED COPPER ALLOY WITH IRON AND PHOSPHOROUS

This is a continuation of application Ser. No. 07/356,097 filed May 24, 1989.

FIELD OF THE INVENTION

The present invention relates to copper alloys, and more particularly, to copper alloys that are suitable for use as an electrical conductor in an automotive wire harness because they have high strength to mechanical impact and good electrical characteristics, in particular, high conductivity, and because the vehicle harness weight can be reduced when such an alloy is used.

BACKGROUND OF THE INVENTION

Automobiles are generally classified as two types depending on whether the power transmission is manual or automatic. Soft copper wires are predominantly used as electrical conductors in an automotive wire harness. Because automobiles with an automatic transmission system are gaining wider acceptance today, there has been a shift from use of a carburetor to an electronic fuel injection system and a corresponding increase in the number of electronic instruments and other devices aboard vehicles. As a result, the number of electric and electronic wiring circuits in an automobile has increased so markedly that an increase not only in the space of the automobile occupied by the wire harness but also in the vehicle harness weight has occurred. From the viewpoint of fuel economy, the vehicle weight is desirably as light as possible and the increase in the volume of the automotive wire harness is not consistent with this objective. Hence, a need has arisen to reduce the automotive harness weight and space for the principal purpose of reducing the vehicle weight.

Theoretically, a very thin wire such as a lead will suffice for use in small-current circuits such as those including micro-computers in an automotive harness. In practice, however, the vibrational impact that develops while the car is running is so great that, in the absence of high mechanical strength, disconnection of the joints or wire breakage might occur to impede smooth running of the car. Therefore, in order to insure sufficient mechanical strength, it has been necessary to use conductors thicker than the diameter theoretically required in electrical terms.

To realize lighter electric wires, hard copper wires that are capable of insuring mechanical strength with small conductor diameter have been considered. However, the elongation of hard copper is so small that even if two terminals of hard copper wires are joined by thermocompression, the joint may be damaged under an externally exerted mechanical load. Thus, the area at which the terminals are thermocompressed becomes a mechanical weak point, which will readily break upon external impact and hence has low reliability.

The automotive harness weight could be reduced by employing smaller-diameter conductors but with conventional soft copper wires, the outside diameter of a conductor cannot be reduced without loss of mechanical strength. Under these circumstances, Cu-Sn alloys, Cu-Fe-P alloys useful as lead materials, Cu-Fe-P-Ni-Sn alloys, etc. have been designed as copper alloys that have high strength, improved cyclic bending strength and good electric conductivity and which, as a result, insure the production of conductors having satisfactory mechanical strength even if their outside diameter is reduced.

As shown in JP-B-60-30043 (the term "JP-B" as used herein means an "examined Japanese patent publication"), Cu-Sn alloys have satisfactory elongation and cyclic bending strength. Although their tensile strength is improved by forming a solid solution of Sn, the improvement is still insufficient. Another disadvantage of Cu-Sn alloys is their low conductivity. Cu-Fe-P alloys are designed to provide improved conductivity and tensile strength by dispersing and/or precipitating an Fe-P compound therein. However, the elongation and cyclic bending strength of Cu-Fe-P alloys are too small to justify their use as conductor materials. Cu-Fe-P-Ni-Sn alloys are intended to provide improved tensile strength by dispersing and/or precipitating an Fe-P compound and by forming a solid solution of Sn. Although Cu-Fe-P-Ni-Sn alloys have excellent elongation and cyclic bending strength, they have the disadvantage that Sn is dissolved in such a great amount that a marked drop in electric conductivity occurs.

SUMMARY OF THE INVENTION

According to the present invention, the present invention provides copper alloys that have high strength against mechanical impact, that exhibit high conductivity as an electrical characteristic and that are lightweight.

According to the present invention the copper alloys comprise:

(A) 0.15–1.0 wt % Fe,
(B) 0.05–0.3 wt % P, and
(C)
(1) 0.01–0.1 wt % Ni and 0.01–0.05 wt % Si
(2) 0.01–0.1 wt % Ni and 0.005–0.05 wt % B
(3) 0.05–0.3 wt % Mg and 0.05–0.3 wt % Pb or
(4) 0.01–0.1 wt % Mn and 0.005–0.05 wt % Si with the balance being essentially composed of Cu.

More specifically, this objective is attained in a first embodiment by a copper alloy that contains
0.15–1.0 wt % Fe,
0.05–0.3 wt % P,
0.01–0.1 wt % Ni and
0.01–0.05 wt % Si,
with the balance being essentially composed of Cu.

This objective is also attained in a second embodiment by a copper alloy that contains
0.15–1.0 wt % Fe,
0.05–0.3 wt % P,
0.01–0.1 wt % Ni and
0.005–0.05 wt % B,
with the balance being essentially composed of Cu.

This objective is further attained in a third embodiment by a copper alloy that contains
0.15–1.0% wt % Fe,
0.05–0.3 wt % P,
0.05–0.3 wt % Mg and
0.05–0.3 wt % Pb,
with the balance being essentially composed of Cu.

Moreover, in a fourth embodiment of the present inventions, the invention provides a high-strength, high-conductivity copper alloy which contains
0.15–1.0 wt % Fe,
0.05–0.3 wt % P,
0.01–0.1 wt % Mn and
0.005–0.05 wt % Si,
with the balance being essentially composed of Cu.

BRIEF DESCRIPTION OF THE DRAWING

The FIGURE illustrates the method of conducting a cyclic bend test on examples of the present invention, and on comparative samples, where 1 is a jig; 2 is a test piece and W is the tensile load.

DETAILED DESCRIPTION OF THE INVENTION

Figure 1:
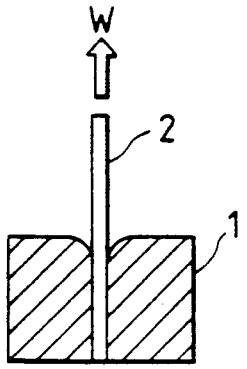
Figure 1:
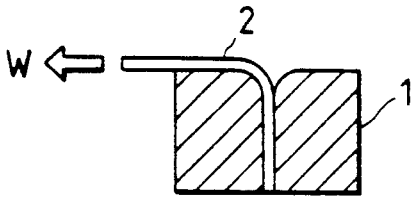
Figure 1:
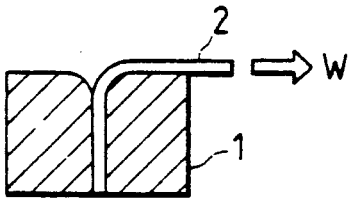
Figure 1:
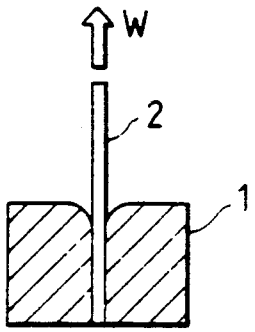

According to this first embodiment of the present invention, Fe-P and Fe-Ni compounds are dispersed and/or precipitated in the Cu matrix phase so as to improve conductivity and tensile strength and, furthermore, elongation is improved not only by the precipitation of a Si-Ni compound but also by the deoxidizing action of Si.

In the first embodiment of the present invention, the Fe content is adjusted to within the range of 0.15–1.0 wt % for the following reasons. If the Fe content is less than 0.15 wt %, the improvement in tensile strength by precipitation of an Fe-P compound is small. If the Fe content exceeds 1.0 wt %, more Fe will dissolve in the Cu matrix phase and the conductivity of the alloy will be greatly impaired.

In the first embodiment of the present invention, the P content is adjusted to within the range of 0.05 –0.3 wt % for the following reasons. If the P content is less than 0.05 wt %, the improvement in tensile strength by precipitation of an P-Fe compound is small. If the P content exceeds 0.3 wt %, more P will dissolve in the Cu matrix phase causing a reduction in conductivity.

In the first embodiment of the present invention, the Ni content is adjusted to within the range of 0.01–0.1 wt % for the following reasons. If the Ni content is less than 0.01 wt %, an Ni-Fe compound will not precipitate in a sufficient amount to improve the tensile strength. If the Ni content exceeds 0.1 wt %, conductivity will decrease.

In the first embodiment of the present invention, the Si content is adjusted to within the range of 0.01–0.5 wt % for the following reasons. If the Si content is less than 0.01 wt %, the improvement in elongation and cyclic bending strength by precipitation of an Ni-Si compound and by the deoxidizing action of Si is small. If the Si content exceeds 0.05 wt %, conductivity will decrease.

According to the second embodiment of the present invention, Fe-P and Fe-Ni compounds are also dispersed and/or precipitated in the Cu matrix phase to improve conductivity and tensile strength and, furthermore, elongation and cyclic bending strength are improved not only by the deoxidizing action of B but also by the precipitation of a B-Fe compound.

In the second embodiment of the present invention, the Fe content is adjusted to within the range of 0.15–1.0 wt % for the following reasons. If the Fe content is less than 0.15 wt %, the improvement in tensile strength by precipitation of an Fe-P compound is small. If the Fe content exceeds 1.0 wt %, more Fe will dissolve in the Cu matrix phase and the conductivity of the alloy will be greatly impaired.

In the second embodiment of the present invention, the P content is adjusted to within the range of 0.05–0.3 wt % for the following reasons. If the P content is less than 0.05 wt %, the improvement in tensile strength by precipitation of a P-Fe compound is small. If the P content exceeds 0.3 wt % more P will dissolve in the Cu matrix phase causing a reduction in conductivity.

In the second embodiment of the present invention, the Ni content is adjusted to within the range of 0.01–0.1 wt % for the following reasons. If the Ni content is less than 0.01 wt %, a Ni-Fe compound will not precipitate in a sufficient amount to improve tensile strength. If the Ni content exceeds 0.1 wt %, conductivity will decrease.

In the second embodiment of the present invention, the B content is adjusted to within the range of 0.005–0.5 wt % for the following reasons. If the B content is less than 0.005 wt %, the improvement in elongation and cyclic bending strength by the deoxidizing action of B and by precipitation of a B-Fe compound is small. If the B content exceeds 0.05 wt %, not only will conductivity decrease but also the workability of the alloy will be impaired.

According to the third embodiment of the present invention, Fe, P and Mg compounds are dispersed and/or precipitated in the Cu matrix phase so as to improve conductivity and tensile strength and, furthermore, elongation and cyclic bending strength are improved by addition of Pb.

In this embodiment of the present invention, the Fe content is adjusted to within the range of 0.15–1.0 wt % for the following reasons. If the Fe content is less than 0.15 wt %, the improvement in tensile strength by precipitation of Fe-P and Fe-Mg compounds is small. If the Fe content exceeds 1.0 wt % more Fe will dissolve in the Cu matrix phase and the conductivity of the alloy will be greatly impaired.

In this third embodiment of the present invention, the P content is adjusted to within the range of 0.05–0.3 wt % for the following reasons. If the P content is less than 0.05 wt %, the improvement in tensile strength by precipitation of P-Fe and P-Mg compounds is small. If the P content exceeds 0.3 wt %, more P will dissolve in the Cu matrix phase with a reduction in conductivity ocurring.

In this third embodiment of the present invention, the Mg content is adjusted to within the range of 0.05–0.03 wt % for the following reasons. If the Mg is less than 0.05 wt %, Mg-Fe and Mg-P compounds will not precipitate in sufficient amounts to improve tensile strength. If the Mg content exceeds 0.3 wt %, castability will decrease. In addition, more Mg will dissolve in the Cu matrix phase with a reduction in conductivity occurring.

In this embodiment of the present invention, the Pb content is adjusted to within the range of 0.05–0.3 wt % for the following reasons. If the Pb content is less than 0.05 wt %, the improvement in elongation and cyclic bending strength is small. If the Pb content exceeds 0.3 wt %, coarse grains of Pb will precipitate at the grain boundaries of Cu, reducing rather than increasing tensile strength, elongation and cyclic bending strength.

In the fourth embodiment of the present invention, the Fe content is adjusted to within the range of 0.15–1.0 wt % for the following reasons. If the Fe content is less than 0.15 wt %, the improvement in tensile strength by precipitation of a Fe-P compound is small. If the Fe content exceeds 1.0 wt %, more Fe will dissolve in the Cu matrix phase and the conductivity of the alloy will be greatly impaired.

In this fourth embodiment of the present invention, the P content is adjusted to within the range of 0.05–0.3 wt % for the following reasons. If the P content is less than 0.05 wt %, the improvement in tensile strength by precipitation of a P-Fe compound is small. Furthermore, the improvement in elongation that can be attained by precipitation of a P-Mn compound is negligible. If the P content exceeds 0.3 wt %, more P will dissolve in the Cu matrix phase with a reduction in conductivity occurring.

In this embodiment of the present invention, the Mn content is adjusted to within the range of 0.01–0.1 wt % for the following reasons. If the Mn content is less than 0.01 wt %, not only is the improvement in tensile strength by dissolution of Mn small but also the improvement in elongation by precipitation of Mn-P or Mn-Si compound is small. If the Mn content exceeds 0.1 wt%, more Mn will dissolve in the Cu matrix phase causing a reduction in conductivity.

In this fourth embodiment, the Si content is adjusted to within the range of 0.005–0.05 wt % for the following reasons. If the Si content is less than 0.005 wt %, the improvement in elongation due to precipitation of an Si-Mn compound is small. If the Si content exceeds 0.05 wt %, conductivity will decrease.

The present invention is illustrated in greater detail by reference to the following nonlimiting examples.

EXAMPLE 1

Copper covered with charcoal was melted in an inert gas atmosphere and Fe, P, Ni and Si were added in the form of a mother alloy to obtain homogeneous melts. These melts were cast continuously into bars (20 mmϕ) having the compositions shown in Table 1 below. The bars were cold-rolled and drawn into wires (3.2 mmϕ), which were subjected to a solid solution treatment in an inert gas atmosphere at ca. 900° C. for 1 hour, quenched with water, further drawn to a diameter of 1.0 mm, and finally aged in an inert gas atmosphere at 480° C. for 2 hour. Measurements of tensile strength, elongation, conductivity and cyclic bending strength of the wire thus obtained were made. The same procedures were repeated for comparative samples shown below.

TABLE 1

| | Alloy No. | Composition (wt %) Fe | P | Ni | Si | B | Sn | Cu | Conductivity (% IACS) | Tensile strength (kg/mm²) | Elongation (%) | Cyclic bending Strength (cycles) |
|---|---|---|---|---|---|---|---|---|---|---|---|---|
| Example 1 | 1 | 0.29 | 0.08 | 0.05 | 0.01 | — | — | bal. | 81.6 | 51.0 | 8.1 | 41 |
| | 2 | 0.35 | 0.13 | 0.08 | 0.03 | — | — | bal. | 82.0 | 52.1 | 7.0 | 40 |
| | 3 | 0.30 | 0.12 | 0.02 | 0.01 | — | — | bal. | 82.3 | 51.6 | 7.5 | 39 |
| | 4 | 0.78 | 0.25 | 0.09 | 0.04 | — | — | bal. | 80.9 | 52.3 | 7.3 | 40 |
| | 5 | 0.84 | 0.21 | 0.08 | 0.02 | — | — | bal. | 80.2 | 52.9 | 7.6 | 39 |
| Comparative samples | 1 | — | — | — | — | — | 0.59 | bal. | 61.3 | 39.0 | 15.0 | 38 |
| | 2 | 1.10 | 0.27 | — | — | — | — | bal. | 73.0 | 52.0 | 1.5 | 30 |
| | 3 | 0.11 | 0.04 | 0.04 | — | — | 1.05 | bal. | 49.0 | 51.5 | 8.2 | 39 |
| | 4 | 0.12 | 0.03 | 0.06 | 0.02 | — | — | bal. | 82.7 | 44.7 | 7.0 | 36 |
| | 5 | 0.61 | 0.18 | 0.25 | 0.003 | — | — | bal. | 68.3 | 52.6 | 4.0 | 33 |
| | 6 | 1.20 | 0.48 | 0.02 | 0.10 | — | — | bal. | 62.3 | 48.8 | 6.5 | 37 |
| | Hard Cu | — | — | — | — | — | — | bal. | 98.3 | 49.8 | 1.0 | 19 |
| | Soft Cu | — | — | — | — | — | — | bal. | 100.3 | 23.3 | 27.4 | 41 |

The bending test method conducted is illustrated in the Figure. A test piece 2 fixed at one end on jig 1 is subjected to 90° cyclic bending, with a tensile load (W) of 2 kg being applied to the other end. One bend cycle consisted of the four steps as shown the Figure corresponding to (A), (B), (C) and (D). The test is continued until the sample breaks and the number of cycles required for breakage to occur is used as an index of the cyclic bending strength of the sample.

As will become apparent by comparing the results of Example 1 with the comparative samples that are shown in Table 1 above, improved conductivity and tensile strength can be attained by dispersing and/or precipitating Fe-P and Fe-Ni compounds according to the first embodiment of the present invention. More specifically, tensile strength values comparable to or better than that of hard copper can be insured by the precipitation of Fe-P and Fe-Ni compounds that occurs in the aging treatment. Although some reduction in conductivity is unavoidable due to trace alloying elements dissolved in the Cu matrix phase, conductivity levels equivalent to at least 80% IACS can be achieved. According to the first embodiment of the present invention, elongation is not as good as in the case of soft copper tested as a comparative sample but it is 7–8 times higher than the value for hard copper which is another comparative sample. Cyclic bending strength is comparable to the value for soft copper.

EXAMPLE 2

Copper covered with charcoal was melted in an inert gas atmosphere and Fe, P, Ni and B were added in the form of a mother alloy to obtain homogeneous melts. These melts were cast continuously into bars (20 mmϕ) having the compositions shown in Table 2 below. The bars were cold-rolled and drawn to wires (3.2 mmϕ), which were subjected to a solid solution treatment in an inert gas atmosphere at ca. 900° C. for 1 hour, quenched with water, further drawn to a diameter of 1.0 mm, and finally aged in an inert gas atmosphere at 480° C. for 2 hour. Measurements of tensile strength, elongation, conductivity and cyclic bending strength of the wires thus obtained were made. The same procedures were repeated for comparative samples shown below.

TABLE 2

| | Alloy No. | Composition (wt %) Fe | P | Ni | Si | B | Sn | Cu | Conductivity (% IACS) | Tensile strength (kg/mm²) | Elongation (%) | Cyclic bending Strength (cycles) |
|---|---|---|---|---|---|---|---|---|---|---|---|---|
| Example 2 | 1 | 0.21 | 0.07 | 0.07 | — | 0.020 | — | bal. | 83.2 | 50.4 | 8.1 | 40 |
| | 2 | 0.32 | 0.10 | 0.03 | — | 0.008 | — | bal. | 82.8 | 52.1 | 7.8 | 38 |
| | 3 | 0.41 | 0.15 | 0.09 | — | 0.010 | — | bal. | 81.5 | 51.5 | 8.3 | 40 |
| | 4 | 0.49 | 0.13 | 0.07 | — | 0.035 | — | bal. | 81.9 | 51.7 | 8.5 | 38 |
| | 5 | 0.73 | 0.28 | 0.05 | — | 0.023 | — | bal. | 80.5 | 53.0 | 7.7 | 39 |

TABLE 2-continued

| | Alloy No. | Composition (wt %) Fe | P | Ni | Si | B | Sn | Cu | Conductivity (% IACS) | Tensile strength (kg/mm²) | Elongation (%) | Cyclic bending Strength (cycles) |
|---|---|---|---|---|---|---|---|---|---|---|---|---|
| Comparative samples | 1 | — | — | — | — | — | 0.59 | bal. | 61.3 | 39.0 | 15.0 | 38 |
| | 2 | 1.10 | 0.27 | — | — | — | — | bal. | 73.0 | 52.0 | 1.5 | 30 |
| | 3 | 0.11 | 0.04 | 0.04 | — | — | 1.05 | bal. | 49.0 | 51.5 | 8.2 | 39 |
| | 4 | 0.54 | 0.16 | 0.05 | — | 0.002 | — | bal. | 81.3 | 52.4 | 3.5 | 32 |
| | 5 | 1.35 | 0.28 | 0.04 | — | 0.070 | — | bal. | 59.4 | 50.3 | 6.0 | 36 |
| | 6 | 0.37 | 0.40 | 0.08 | — | 0.003 | — | bal. | 65.5 | 49.9 | 3.8 | 33 |
| | Hard Cu | — | — | — | — | — | — | bal. | 98.3 | 49.8 | 1.0 | 19 |
| | Soft Cu | — | — | — | — | — | — | bal. | 100.3 | 23.3 | 27.4 | 41 |

The bending test conducted was the same as described for Example 1.

TABLE 3

| | Alloy No. | Composition (wt %) Fe | P | Mg | Pb | Ni | Sn | Cu | Conductivity (% IACS) | Tensile strength (kg/mm²) | Elongation (%) | Cyclic bending Strength (cycles) |
|---|---|---|---|---|---|---|---|---|---|---|---|---|
| Example | 1 | 0.30 | 0.09 | 0.08 | 0.12 | — | — | bal. | 82.2 | 51.2 | 8.6 | 43 |
| | 2 | 0.36 | 0.12 | 0.26 | 0.18 | — | — | bal. | 80.6 | 52.8 | 8.5 | 41 |
| | 3 | 0.32 | 0.12 | 0.13 | 0.28 | — | — | bal. | 82.5 | 51.5 | 9.4 | 44 |
| | 4 | 0.81 | 0.26 | 0.14 | 0.22 | — | — | bal. | 81.8 | 52.6 | 8.6 | 43 |
| | 5 | 0.21 | 0.08 | 0.21 | 0.12 | — | — | bal. | 81.4 | 51.4 | 8.4 | 42 |
| | 6 | 0.41 | 0.15 | 0.24 | 0.18 | — | — | bal. | 81.0 | 53.1 | 8.0 | 40 |
| Comparative samples | 1 | — | — | — | — | — | 0.59 | bal. | 61.3 | 39.4 | 15.0 | 38 |
| | 2 | 1.10 | 0.27 | — | — | — | — | bal. | 73.0 | 52.0 | 1.8 | 30 |
| | 3 | 0.11 | 0.04 | — | — | 0.04 | 1.05 | bal. | 49.0 | 51.5 | 8.2 | 39 |
| | 4 | 0.12 | 0.03 | 0.08 | 0.12 | — | — | bal. | 81.6 | 41.2 | 8.6 | 42 |
| | 5 | 0.61 | 0.18 | 0.42 | 0.02 | — | — | bal. | 68.2 | 49.2 | 3.8 | 34 |
| | 6 | 0.30 | 0.09 | 0.18 | 0.48 | — | — | bal. | 75.4 | 41.8 | 3.4 | 33 |
| | Hard Cu | — | — | — | — | — | — | bal. | 98.3 | 49.8 | 1.0 | 19 |
| | Soft Cu | — | — | — | — | — | — | bal. | 100.3 | 23.3 | 27.4 | 41 |

As will become apparent by comparing the results of Example 2 with the comparative samples that are shown in Table 2 below, improved conductivity and tensile strength can be obtained by dispersing and/or precipitating Fe-P and Fe-Ni compounds according to the second embodiment of the present invention. More specifically, tensile strength values comparable to or better than that of hard copper can be insured by the precipitation of Fe-P and Fe-Ni compounds that occurs in the aging treatment. Although some reduction in conductivity is unavoidable on account of trace alloying elements dissolved in the Cu matrix phase, conductivity levels equivalent to at least 80% IACS can be attained. According to the second embodiment of the present invention, elongation is not as good as in the case of the soft copper test as a comparative sample but it is 7.5–8.5 times as high as the value for hard copper which is another comparative sample. Cyclic bending strength is comparable to the value for soft copper.

EXAMPLE 3

Copper covered with charcoal was melted in an inert gas atmosphere in an electric furnace and Fe and P were added in the form of a mother alloy whereas Mg and Pb were added in the form of a pure metal, to obtain homogeneous melts. These melts were cast continuously into bars (20 mmϕ) having the compositions shown in Table 3 below. The bars were cold-rolled and drawn to wires (3.2 mmϕ), which were subjected to a solid solution treatment in an inert gas atmosphere at ca. 900° C. for 1 hour, quenched with water, further drawn to a diameter of 1.0 mm. and finally aged in an inert gas atmosphere at 480° C. for 2 hours. Measurements of tensile strength, elongation, conductivity and cyclic bending strength were made on the wires thus obtained. The same procedures were repeated for the comparative samples.

The bending test method was the same as described in Example 1.

As will become apparent by comparing the results of the sample with the comparative samples that are shown in Table 3, improved conductivity and tensile strength can be attained by dispersing and/or precipitating an Fe-P-Mg compound according to the present invention. More specifically, the decrease in tensile strength due to the annealing effect which accompanies aging is compensated for by the precipitation of an Fe-P-Mg compound, thus insuring tensile strength values comparable to or better than that of hard copper. As for conductivity, some reduction is unavoidable due to trace alloying elements dissolved in the Cu matrix phase, but conductivity levels equivalent to at least 80% IACS can be attained. According to this embodiment of the present invention, elongation is not as good as in the case of soft copper tested as a comparative sample but it is 8–9 times as high as the value for hard copper which is another comparative sample. Cyclic bending strength is comparable to the value for soft copper.

EXAMPLE 4

Copper covered with charcoal was melted in an inert gas atmosphere in an electric furnace and Fe, P, Mn and Si were added in the form of a mother alloy to obtain homogeneous melts. These melts were cast continuously into bars (20 mmϕ) having the compositions shown in Table 4 below. The bars were cold-rolled and drawn to wires (3.2 mmϕ), which were subjected to a solid solution treatment in an inert gas atmosphere at ca. 900° C. for 1 hour, quenched with water, further drawn to a diameter of 1.0 mm, and finally aged in an inert gas atmosphere at 480° C. for 2 hours. The wires thus obtained were subjected to measurements of tensile strength, elongation, conductivity and cyclic bending strength. The same procedures were repeated for the comparative samples.

TABLE 4

| | Alloy No. | Composition (wt %) Fe | P | Mn | Si | Sn | Cu | Conductivity (% IACS) | Tensile strength (kg/mm$^2$) | Elongation (%) | Cyclic bending Strength (cycles) |
|---|---|---|---|---|---|---|---|---|---|---|---|
| Example | 1 | 0.25 | 0.07 | 0.02 | 0.01 | — | bal. | 81.0 | 50.3 | 7.3 | 39 |
| | 2 | 0.31 | 0.11 | 0.05 | 0.02 | — | bal. | 81.6 | 50.8 | 7.5 | 39 |
| | 3 | 0.39 | 0.14 | 0.08 | 0.04 | — | bal. | 80.9 | 51.5 | 7.0 | 38 |
| | 4 | 0.63 | 0.23 | 0.06 | 0.015 | — | bal. | 81.3 | 51.2 | 7.2 | 39 |
| | 5 | 0.84 | 0.30 | 0.03 | 0.008 | — | bal. | 80.2 | 50.6 | 7.9 | 40 |
| Comparative samples | 1 | — | — | — | — | 0.59 | bal. | 61.3 | 39.4 | 15.0 | 38 |
| | 2 | 1.10 | 0.27 | — | — | — | bal. | 73.0 | 52.0 | 1.5 | 30 |
| | 3 | 0.10 | 0.04 | 0.07 | 0.03 | — | bal. | 83.1 | 40.7 | 8.1 | 40 |
| | 4 | 0.35 | 0.13 | 0.20 | 0.02 | — | bal. | 65.6 | 54.3 | 4.3 | 32 |
| | 5 | 0.63 | 0.23 | 0.05 | 0.10 | — | bal. | 69.8 | 52.1 | 6.5 | 37 |
| | Hard Cu | — | — | — | — | — | bal. | 98.3 | 49.8 | 1.0 | 19 |
| | Soft Cu | — | — | — | — | — | bal. | 100.3 | 23.3 | 27.4 | 41 |

The bending test method was as conducted in Example 1.

As will become apparent by comparing the results of the example with the comparative samples that are shown in Table 4 above, improved tensile strength can be attained by the precipitation of an Fe-P compound and the dissolution of Mn according to the present invention. More specifically, a tensile strength comparable to or better than that of hard copper is insured by the precipitation of an Fe-P compound during aging and by the dissolution of Mn. As for conductivity, some reduction is unavoidable due to the Mn dissolved in the Cu matrix phase, but conductivity levels equivalent to at least 80% IACS can be attained. According to this embodiment of the present invention, elongation is not as good as in the case of the soft copper tested as a comparative sample but, through precipitation of Mn together with Si and P, it is improved to 7–8 times the value for hard copper. Cyclic bending strength is also good and substantially comparable to the value for soft copper.

As described above, the copper alloy according to the first embodiment of the present invention has a tensile strength which is at least equal to that of hard copper and its conductivity, although somewhat smaller than that of hard copper, is still equivalent to 80% IACS and above. According to the first embodiment of the present invention, elongation is smaller than that of soft copper but is 7–8 times as good as that of hard copper. Cyclic bending strength that can be attained is comparable to that of soft copper.

The copper alloy according to the second embodiment of the present invention has a tensile strength which is at least equal to that of hard copper and its conductivity, although somewhat smaller than that of hard copper, is still equivalent to 80% IACS and above. According to the second embodiment of the present invention, elongation is smaller than that of soft copper but is 7.5–8.5 times as good as that of hard copper. Cyclic bending strength that can be attained is substantially comparable to that of soft copper.

As described, the copper alloy of the third embodiment of the present invention has a tensile strength which is at least equal to that of hard copper and the conductivity, although somewhat smaller than that of hard copper, is still equivalent to 80% IACS and above. Elongation is smaller than that of soft copper but is 8–9 times as good as that of hard copper. Cyclic bending strength that can be attained is comparable to that of soft copper.

As described above, the copper alloy of the fourth embodiment of the present invention has a tensile strength which is at least equal to that of hard copper and its conductivity, although somewhat smaller than that of hard copper, is still equivalent to 80% IACS and above. According to this embodiment of the present invention, elongation is smaller than that of soft copper but is 7–8 times as good as that of hard copper. Cyclic bending strength that can be attained is comparable to that of soft copper.

Thus, according to the embodiments of the present invention, copper alloys having characteristics that make them suitable for use as conductors in an automotive wire harness can be attained. Even if conductors made of these alloys have small outside diameter, they will insure sufficient mechanical strength to reduce the chance of wire breakage under tensile load or bending at areas where terminals are thermocompressed. The copper alloys of the present invention are also suitable for use as leads, etc. for conductors and semiconductors in the wire hardness of electronic devices.

While the invention has been described in detail and by reference to specific embodiments thereof, various changes and modifications can be made therein without departing from the spirit and scope thereof.

What is claimed is:

1. An aged copper alloy consisting essentially of:
0.15–1.0 wt % Fe,
0.05–0.3 wt % P,
0.05–0.3 wt % Mg and
0.05–0.3 wt % Pb,
with the balance being essentially composed of Cu.

* * * * *